US005539984A

United States Patent [19]

Ikuta et al.

[11] Patent Number: 5,539,984

[45] Date of Patent: Jul. 30, 1996

[54] DRY SHAVER WITH FLOATING CUTTER HEADS

[75] Inventors: Toshio Ikuta; Masao Tanahashi; Takeshi Shiba, all of Hikone, Japan

[73] Assignee: Matsushita Electric Works, Ltd., Osaka, Japan

[21] Appl. No.: 367,825

[22] Filed: Jan. 3, 1995

[30] Foreign Application Priority Data

Jan. 10, 1994 [JP] Japan ..... 6-000949

[51] Int. Cl.[6] ..... B26B 19/10

[52] U.S. Cl. ..... 30/43.92; 30/346.51

[58] Field of Search ..... 30/43.1, 43.6, 30/43.9, 43.92, 346.51

[56] References Cited

U.S. PATENT DOCUMENTS

| | | | |
|---|---|---|---|
| 3,646,673 | 3/1972 | Yamaoka . | |
| 4,271,590 | 6/1981 | Ernst et al. . | |
| 5,189,792 | 3/1993 | Otsuka et al. | 30/43.92 |

FOREIGN PATENT DOCUMENTS

| | | | |
|---|---|---|---|
| 2437912 | 4/1980 | France . | |
| 1116110 | 10/1961 | Germany | 30/43.92 |
| 1801545 | 4/1969 | Germany . | |
| 48-57291 | 7/1973 | Japan . | |
| 1281835 | 7/1972 | United Kingdom . | |
| 1446989 | 8/1976 | United Kingdom . | |

*Primary Examiner*—Douglas D. Watts
*Attorney, Agent, or Firm*—Watson Cole Stevens Davis, P.L.L.C.

[57] ABSTRACT

A dry shaver comprises a head frame mounting at least one cutter head. The cutter head includes a holder carrying an outer foil and an inner cutter which is driven to move in shearing contact with the outer foil. A spring is provided to give a biasing force to bias the inner cutter against the outer foil so as to develop a contacting pressure therebetween. The shaver includes a floating support structure for floatingly supporting the holder to the head frame so that the cutter head can be depressed relative to the head frame. The floating support structure comprises an elastic member which gives an elastic force when the cutter head is displaced relative to the head frame such that cutter head receives a floating force which is a combination of the biasing force and the elastic force and which becomes greater as the cutter head is depressed further. The elastic member develops the elastic force which gives a non-linear relation between the displacement of the cutter head and a depression load applied thereto, and that the non-linear relation has a node of changing elastic constant for displacement of the holder such that the elastic constant is greater when the cutter head is depressed further beyond the node than otherwise. Since the elastic member is only responsible for changing the elastic constant as the cutter head is depressed, the cutter head can be given a light floating force initially and be given an moderately increasing floating force thereafter, yet without resorting to an undue increase in the contacting pressure between the outer foil and the inner cutter.

12 Claims, 10 Drawing Sheets

DRY SHAVER WITH FLOATING CUTTER HEADS

BACKGROUND OF THE INVENTION

1. Field of the Invention

The present invention is directed to a dry shaver with at least one floatingly supported cutter head.

2. Description of the Prior Art

U.S. Pat. No. 5,189,792 discloses a dry shaver in which a cutter head is floatingly supported from a head frame to be capable of being depressed in response to the cutter head being pressed against the skin of a user. The cutter head comprises a holder carrying an outer foil and an inner cutter driven to reciprocate in shearing contact with the outer foil. The inner cutter is urged by a spring against the outer foil to give a suitable contacting pressure therebetween. An elastic support member is provided to give an elastic force for floatingly supporting the holder to the head frame. Thus, the cutter head is floatingly supported to the frame by the combination of a biasing force from the spring and an elastic force from the support member. The elastic support member comprises a resilient beam which exhibits a fixed elastic constant substantially over the depression displacement of the holder relative to the head frame. Consequently, the cutter head carrying the outer foil is floatingly supported with the combination force with a fixed elastic constant having a linear relation between the displacement of the holder and a depression load applied thereto, as indicated by a line L1 in FIG. 9. In the meanwhile, it is found that a comfortable and effective shaving is achieved by changing elastic constant of the supporting structure for the cutter head in such a manner that the cutter head can be initially depressed with a less depression load than when depressed to nearly the end of its depression stroke. That is, the cutter head is preferred to be supported with elastic constant which is lower in the initial depression stroke than otherwise so that it can conform readily to an irregular skin surface with a less depression load for smooth and effective shaving. Such floating support should be made without greatly varying the contacting pressure between the inner cutter and the outer foil for assuring a smooth shaving substantially irrespective of the varying depression amount of the cutter head. In this respect, the shaver of the above patent is not sufficient to give an optimum characteristic to the shaver required for assuring comfortable and effective shaving.

Japanese Utility Model Publication (KOKOKU) No. 48-57291 discloses another prior shaver in which a cutter head is floatingly supported from the head frame singly by a spring which urges the inner cutter to the outer foil. In this shaver, the contacting pressure between the inner cutter and the outer foil increases in direct proportion to the depression displacement. Therefore, the contacting pressure will increase beyond a suitable value when the cutter head is depressed by a large extent. Otherwise, the cutter head is movable only by a limited displacement when it is intended to maintain the contacting pressure within an acceptable range.

A further prior shaver is disclosed in GB 1 281 835 in which a plurality of concentric cutter heads are supported by individual springs which urges the inner cutters receptively against the corresponding outer foils. The springs are arranged such that the center cuter head receives a biasing force from its associated spring plus the biasing forces for the other cutter heads. Thus, the center cutter head can be depressed by a large extent only with accompanied displacement of the other cutter heads. In view of that the individual springs are required to give a suitable contacting pressure between the individual inner cutters and the associated outer foils, when the center cutter head is depressed by a large extent with the accompanying depression of the other cutter head, the center cutter head will have to give a considerably great floating force which is a combination with the floating force of the other cutter heads being pressed. With this result, the center cutter head sees an abrupt increase of the biasing force, which eventually fails to give a moderate contact between the center cutter head and the skin of the user, and therefore reduce shaving efficiency.

SUMMARY OF THE INVENTION

In view of the above insufficiencies and problems, the present invention has been made to provide a dry shaver with a floatingly supported cutter head which can be smoothly depressed while assuring a consistent skin contact for effective shaving throughout the depression range. The dry shaver in accordance with the present invention comprises a head frame mounting at least one cutter head. The cutter head includes a holder carrying an outer foil and an inner cutter which is driven to move in shearing contact with the outer foil. A spring is provided to give a biasing force to bias the inner cutter against the outer foil so as to develop a contacting pressure therebetween. The shaver includes a floating support structure for floatingly supporting the holder to the head frame so that the cutter head can be depressed within a limited displacement relative to the head frame. The floating support structure comprises an elastic member which gives an elastic force when the cutter head is displaced relative to the head frame such that cutter head receives a floating force which is a combination of the biasing force and the elastic force and which becomes greater as the cutter head is depressed further. The characterizing feature of the present invention resides in that the elastic member develops the elastic force which gives a non-linear relation between the displacement of the cutter head and a depression load applied thereto, and that the non-linear relation has a node of changing elastic constant for displacement of the holder such that the elastic constant is greater when the cutter head is depressed further beyond the node than otherwise. Since the elastic member is only responsible for changing the elastic constant as the cutter head is depressed, the cutter head can be easily designed to give a light floating force initially and give a moderately increasing floating force thereafter, yet without accompanying an undue increase in the contacting pressure between the outer foil and the inner cutter.

Accordingly, it is a primary object of the present invention to provide a dry shaver in which the cutter head is capable of being depressed initially with a light depression load and depressed further with an increasing depression load without accompanied with a sudden increase in the contacting pressure between the inner cutter and the outer foil, whereby assuring to move the cutter head smoothly across uneven skin surface of the user for effective shaving.

In a preferred embodiment, the elastic member is composed of a first elastic member and a second elastic member. The first elastic member is arranged to give the elastic force of less elastic constant until the cutter head is depressed to the node, while the second elastic member is cooperative with the first elastic member to give the elastic force of correspondingly enhanced elastic constant only after the cutter head is depressed beyond the node. Therefore, by suitably selecting the first and second elastic members, optimum elastic constants at the initial and further depression can be selected for smoothly depressed contact of the cutter head to the skin of the user, which is therefore another object of the present invention.

The first elastic member is designed to give the elastic force which opposes in direction to the biasing force of the spring during an initial depression displacement of the cutter head so as to weaken the floating force during this displacement, after which the first elastic member gives the elastic force which acts in the same direction as the biasing force. With this arrangement, the cutter head can be depressed initially with greater compliance and therefore can well follow uneven surface of the skin, which is therefore a further object of the present invention.

The head frame has opposed end walls having a width dimension and provided with the first elastic member. The elastic member is in the form of a cantilever which is supported at one end thereof to one width end of the end wall and extends toward the other width end of the end wall to define a connection to the holder immediately adjacent the other width end. In this manner, the first elastic member can extends substantially the full width of the end wall so that it is given an elastic flexibility of small elastic constant which assures a large depression displacement of the cutter head with a small depression load. Whereby the cutter head can be depressed lightly to follow the uneven skin surface of the user for smooth shaving over the uneven skin surface, which is therefore a further object of the present invention.

The second elastic member is preferably a resilient leg which extends from the holder and comes into abutment at a free end thereof against a portion of the head frame after the cutter head is depressed to a limited extent such that the resilient leg is made active for floatingly supporting the holder with the greater elastic constant when the cutter head is depressed further beyond the limited extent than otherwise.

Alternately, the second elastic member may be a rubber which is fixed on the head frame and comes into abutment with the first elastic member when the cutter head is depressed by a limited extent such that the rubber is made active for floatingly supporting the holder with the greater elastic constant when the cutter head is depressed further beyond the limited extent than otherwise.

Further, the second elastic member may be a spring which is fixed on the head frame and which comes into abutment with the first elastic member after the cutter head is depressed by a limited extent such that the spring is made active for floatingly supporting the holder with the greater elastic constant when the cutter head is depressed further beyond the limited extent than otherwise.

Furthermore, the second elastic member may be a resilient beam which extends from the head frame and comes into abutment at a free end thereof against the first elastic member after the cutter head is depressed by a limited extent such that the resilient beam is made active for floatingly supporting the holder with the greater elastic constant when the cutter head is depressed further beyond the limited extent than otherwise.

In another embodiment, the elastic means comprises an elastic crossbar which extends from the head frame with one end thereof connected to the head frame and connected at the other end to the holder so that the elastic crossbar is allowed to flex about the one end defined as a first fulcrum for developing the elastic force as the cutter head is depressed. The elastic crossbar is given a second fulcrum which is spaced away from the first fulcrum toward the connection to the holder so that the crossbar flexes about the first fulcrum to floatingly support the cutter head during an initial depression displacement of the cutter head and flexes about the second fulcrum to support the cutter head with the elastic constant which is greater when the cutter head is further depressed than during the initial depression displacement.

These and still other objects and advantageous features will become more apparent from the following description of the preferred embodiments when taken in conjunction with the attached drawings.

DETAILED DESCRIPTION OF THE EMBODIMENTS

Figure 1:
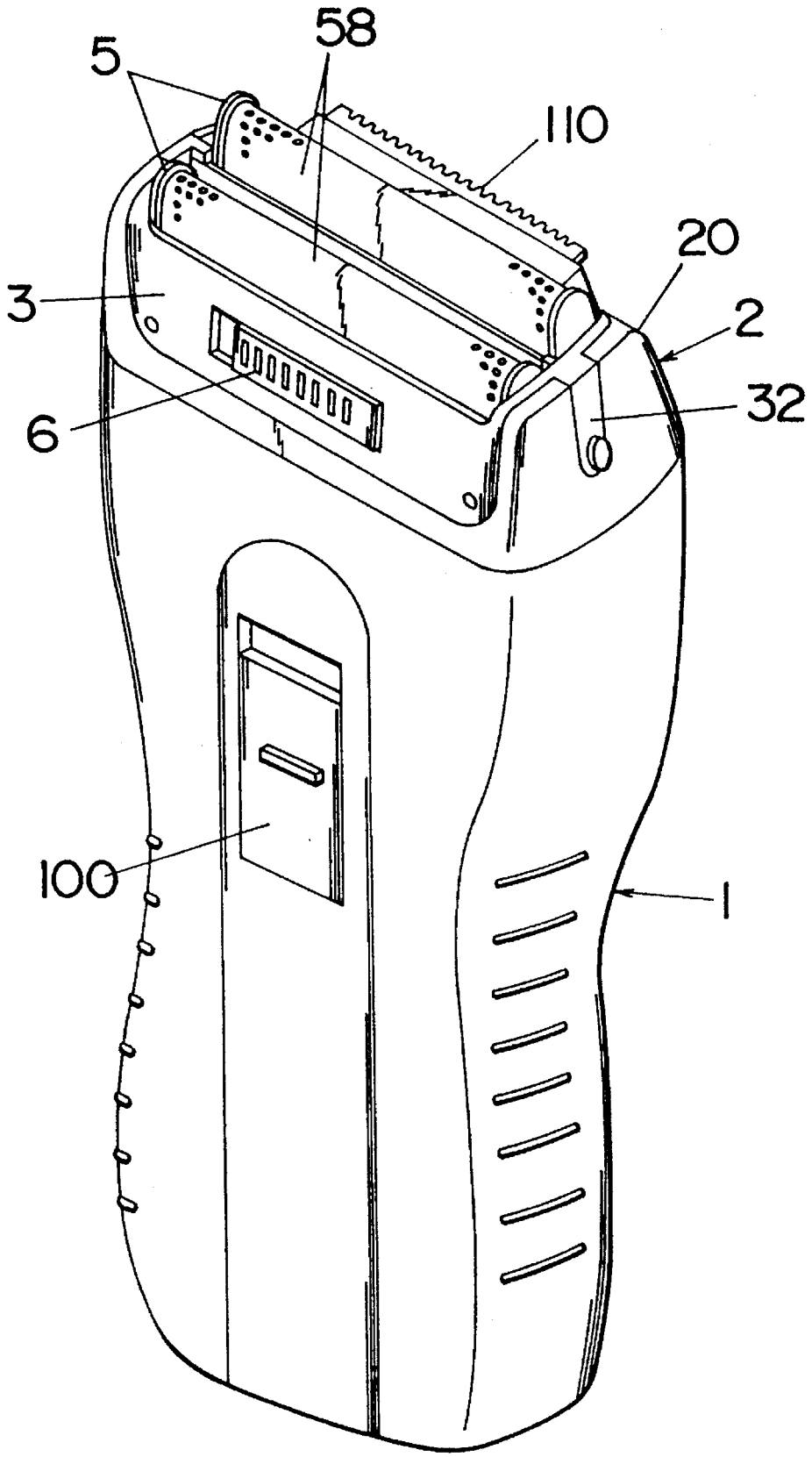
FIG. 1 is a perspective view of a dry shaver in accordance with a first embodiment of the present invention.
Figure 2:
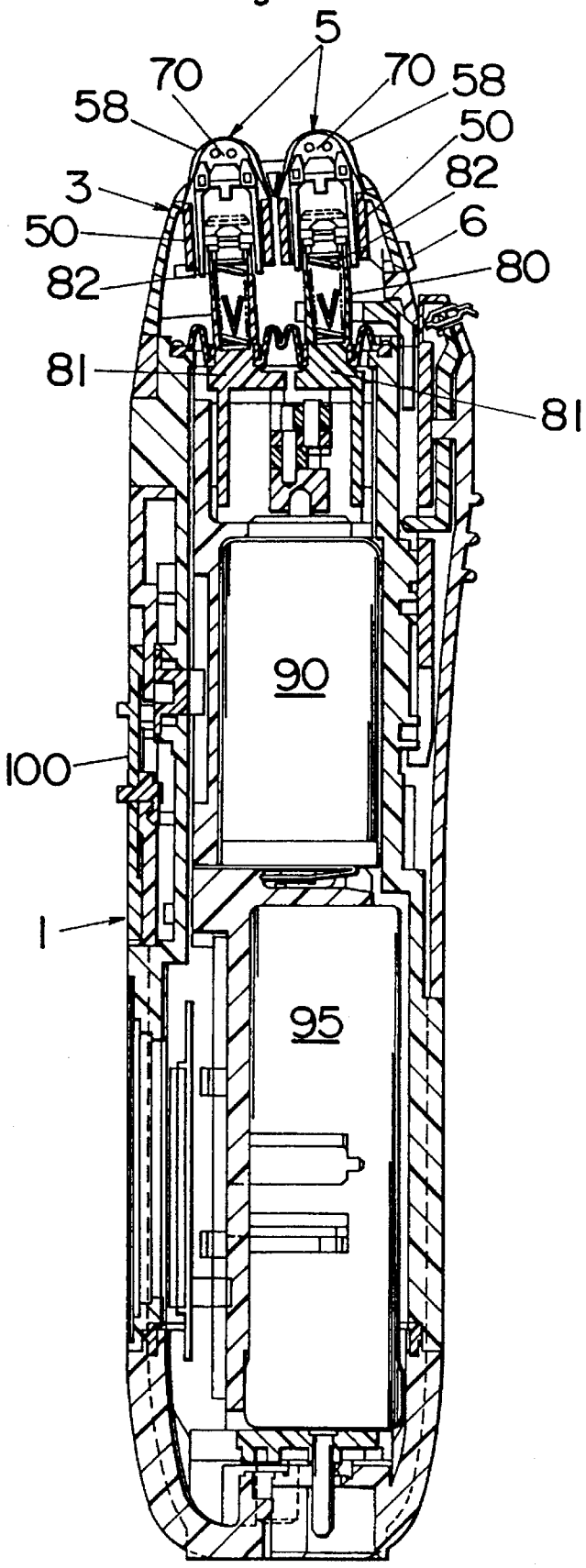
FIG. 2 is a vertical section of the dry shaver.

Referring now to FIGS. 1 to 4, there is shown a reciprocatory dry shaver in accordance with a first embodiment of the present invention. The shaver comprises a shaver housing 1 mounting thereon a shaver head 2 of dual cutter configuration having a parallel pair of elongated cutter heads 5. The shaver head 2 comprises a support frame 20 mounted on the top of the shaver housing I and a head frame 3 detachably supported within the support frame 20. It is by this head frame 3 that the cutter heads 5 are mounted to the support frame 20. Each cutter head 5 comprises an outer shearing foil 58 bent into a generally U-shaped configuration to have an apex which extends longitudinally of the cutter head 5 to define a longitudinal axis of the cutter head 5. As discussed later in detail, the head frame 3 is assembled into a unitary structure including the dual cutter heads 5 and is detachable to the support frame 20 as one replacement part in which the cutter heads 5 are floatingly supported.

Figure 4:
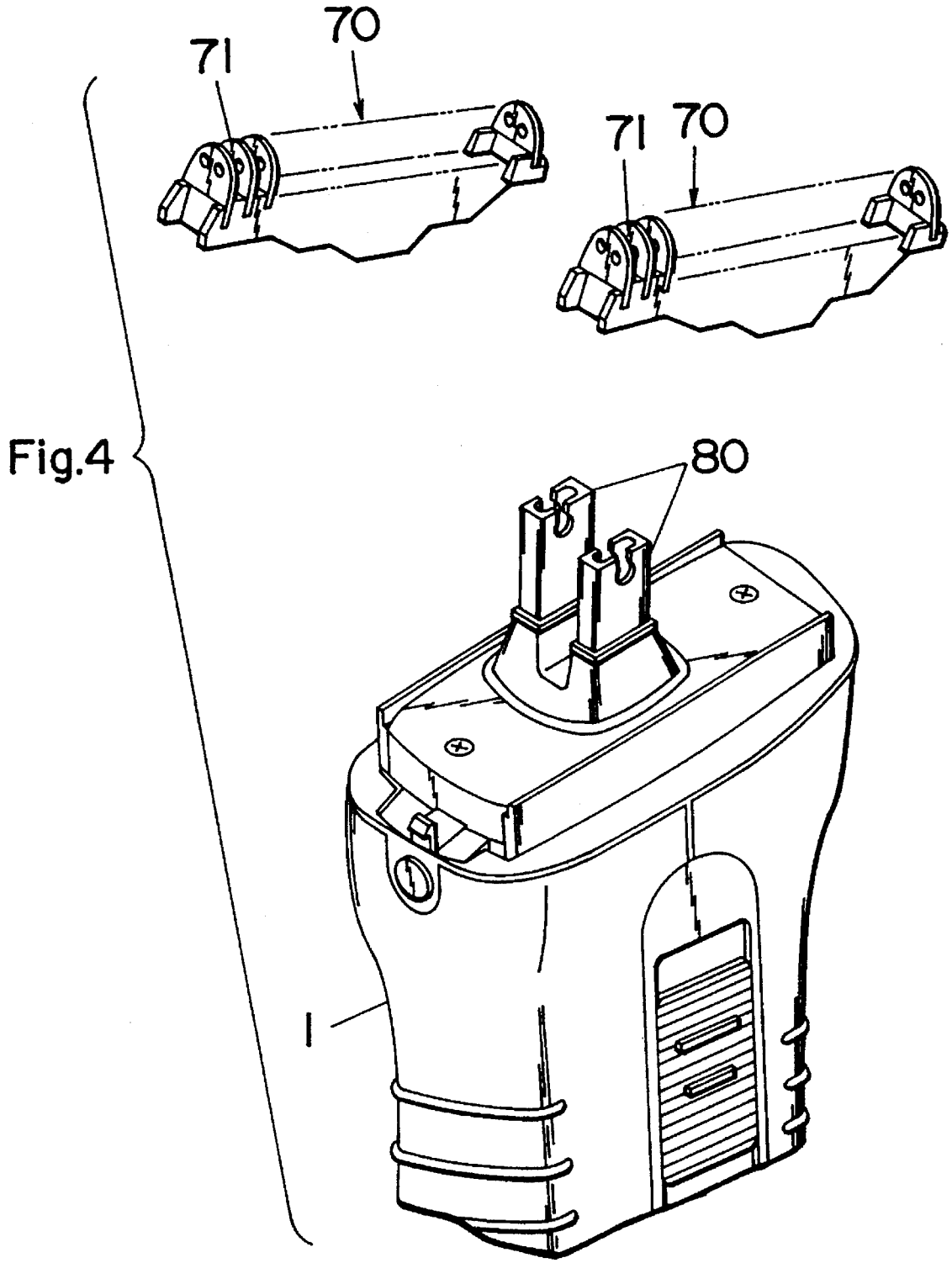
FIG. 4 is an exploded perspective view of the shaver with a portion of the cutting head is removed.

A corresponding pair of inner cutters 70 projects on the top of the housing 1 into hair shearing engagement respectively with the outer shearing foils 58 of the cutter heads 5. As best shown in FIG. 4, the inner cutters 70 each comprising a number of arcuately contoured blades 71 are coupled respectively to reciprocating drive pins 80 projecting on top of the housing 1 so as to be driven thereby in a counter reciprocating manner. The drive pins 80 are coupled to rotary-to-reciprocation conversion elements 81 which are received within the housing 1 and are driven by an incorporated electric motor 90 to reciprocate in opposite direction to each other for canceling the individual vibrations to achieve dynamic balancing of the inner cutters 70. The inner cutters 70 are biased upwardly by means of springs 82 provided at the connection of the drive pins 80 to the inner cutters 70, respectively in order to develop a suitable contacting pressure between the inner cutter 70 and the outer foil 58. The motor 90 is energized by an incorporated rechargeable battery 95 and is turned on and off by an operation of a switch handle 100 slidably mounted on the front face of the housing 1. A vertical slidable trimmer 110 is provided on the rear face of the housing 1 to be utilized independently or in cooperation with the shaver head 2.

Figure 3:
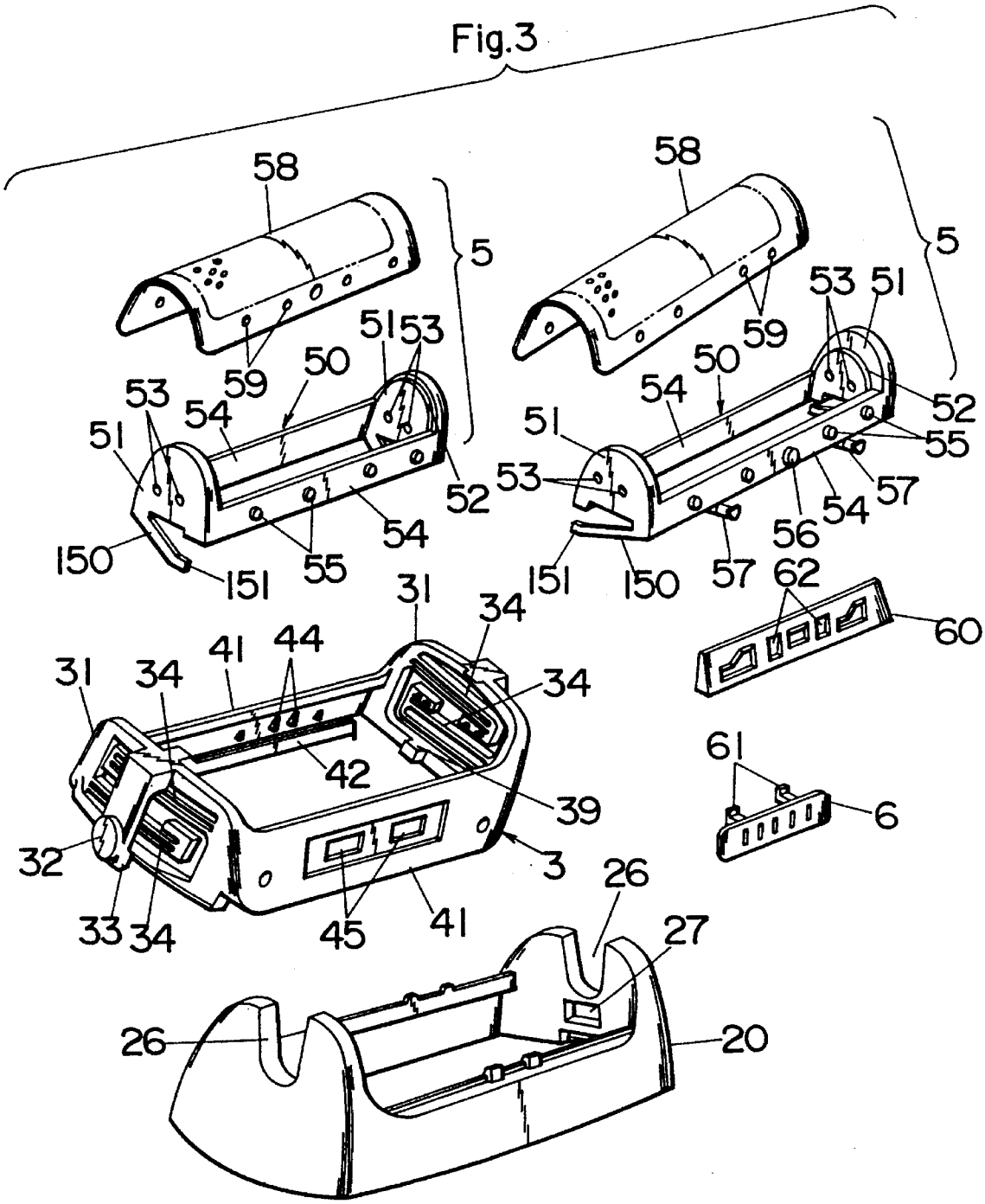
FIG. 3 is an exploded perspective view of a cutting head of the shaver.

Now referring to FIG. 3, the head frame 3 is in the form of a rectangular chassis made of a plastic material to have opposed end walls 31 integrally connected by opposed side walls 41 and a separator rib 42 dividing the interior of the head frame 3 laterally into two openings each receiving one of the cutter heads 5. Each of the end walls 31 is formed with a knob 32 which is received into a corresponding one of vertical slits 26 in the opposed ends of the support frame 20 with a hook 33 at the lower end of the knob 32 engaged into a detent 27 formed in the ends of the support frame 20 adjacent to the bottom of the slit 26 for mounting of the head frame 3 to the support frame 20. The knobs 32 are given resilient deforming capability to such an extent that when the knob 32 is pressed inward the hooks 33 are disengaged out of the detent 27 for removal of the head frame 3 from the support frame 20. The cutter head 5 comprises a rectangular holder 50 molded from a plastic material to have opposed end plates 51 integrally bridged by side bars 54. The outer shearing foil 58 is curved arcuately between the opposed side bars 54 and secured thereto by engagement of posts 55 on the side bars 54 into corresponding apertures 59 in the lateral ends of the shearing foils 56. Each end plate 51 is formed on its inner surface with arcuately contoured guide 52 along which the longitudinal end of the shearing foil 58 is curved. Also, each end plate 51 is provided with holes 53 for connection with the corresponding end wall 31 of the head frame 3. Each side bar 54 is formed on its center with a stud 56 for loose engagement between a pair of guide ribs 44 on the inner surface of the side wall 41 of the head frame 3 in such a manner that the stud 56 is vertically movable between the guide ribs 44. At least one of the holders 50 is formed on the side bar 54 with a pair of longitudinally spaced follower pins 57 for connection with a slider 60 disposed on the interior of one of the side walls 41 of the head frame 3. The slider 60 is connected to a slider handle 6 which is slidable on the exterior of the side wall 41 to be accessible by the user. To this end, the slider handle 6 has a pair of hooks 61 extending through openings 45 in the side wall 41 for engagement with corresponding notches 62 in the slider 60.

Figure 6:
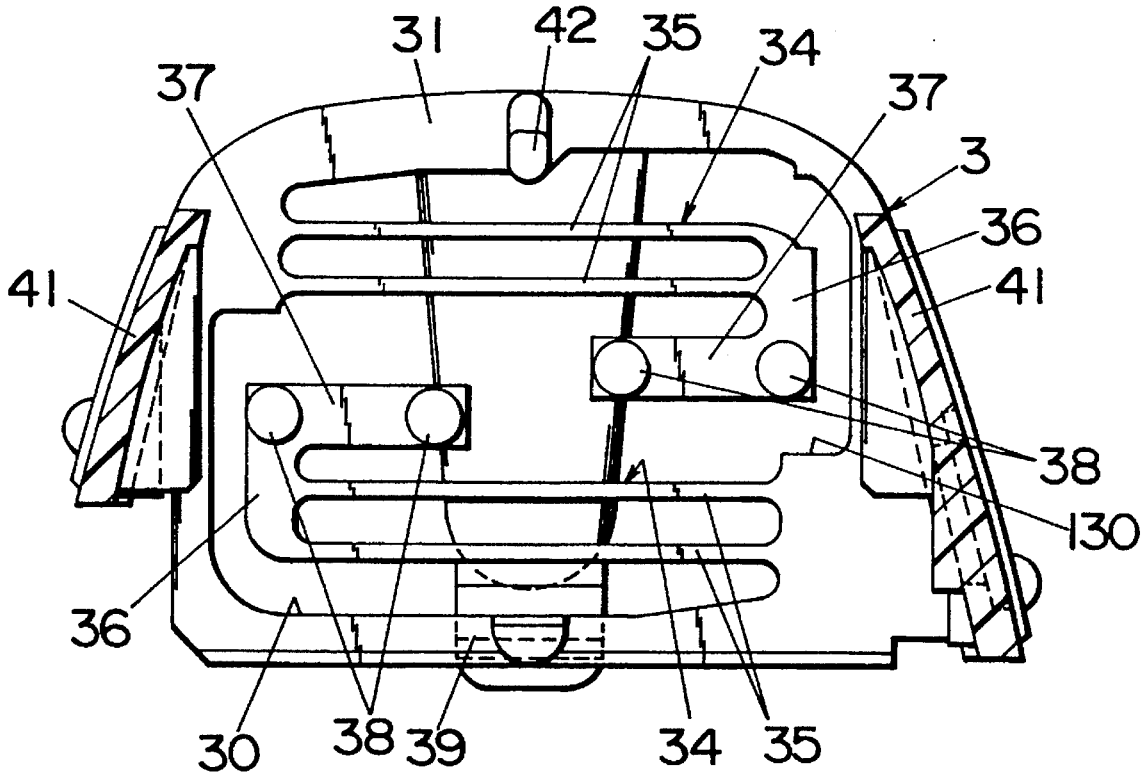
FIG. 6 is an end view, partly in section, of a head frame of the shaver shown in a condition where no upward biasing force from an inner cutter is applied.
Figure 7:
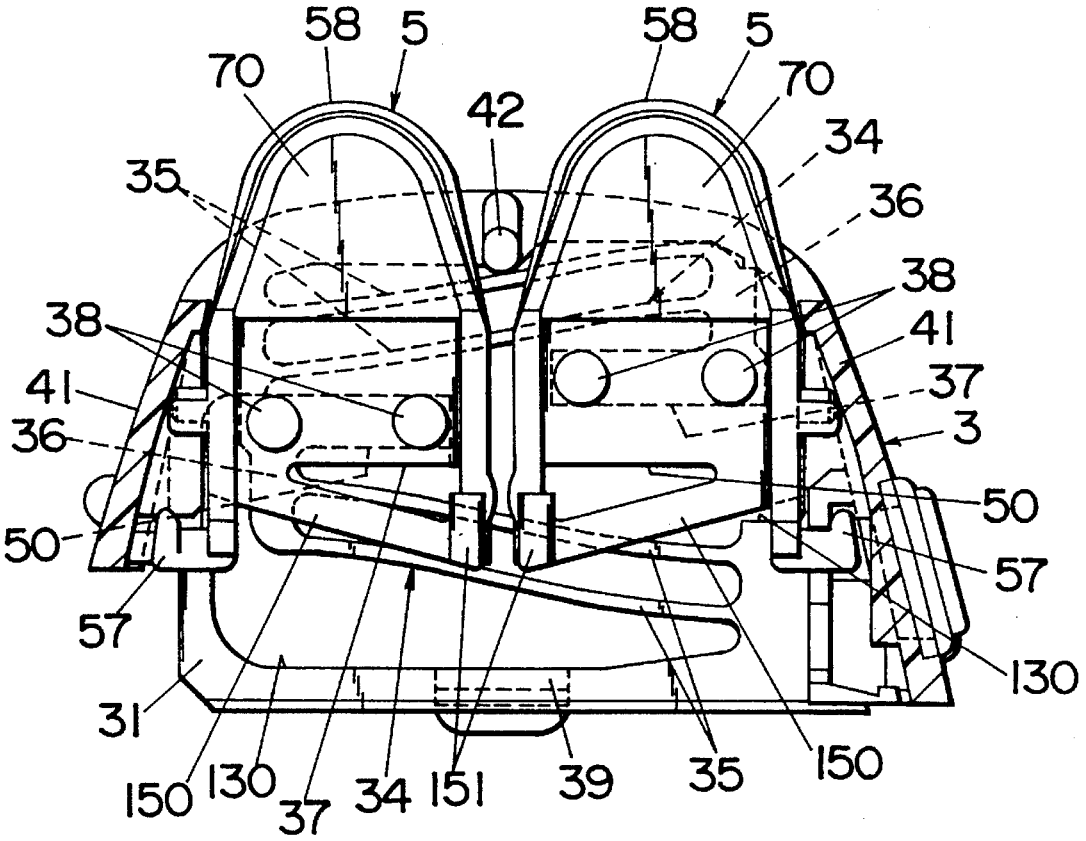
FIGS. 7 and 8 are explanatory views of the cutter heads shown in conditions where no external depressive force is applied and where external depressive force is applied, respectively.
Figure 8:
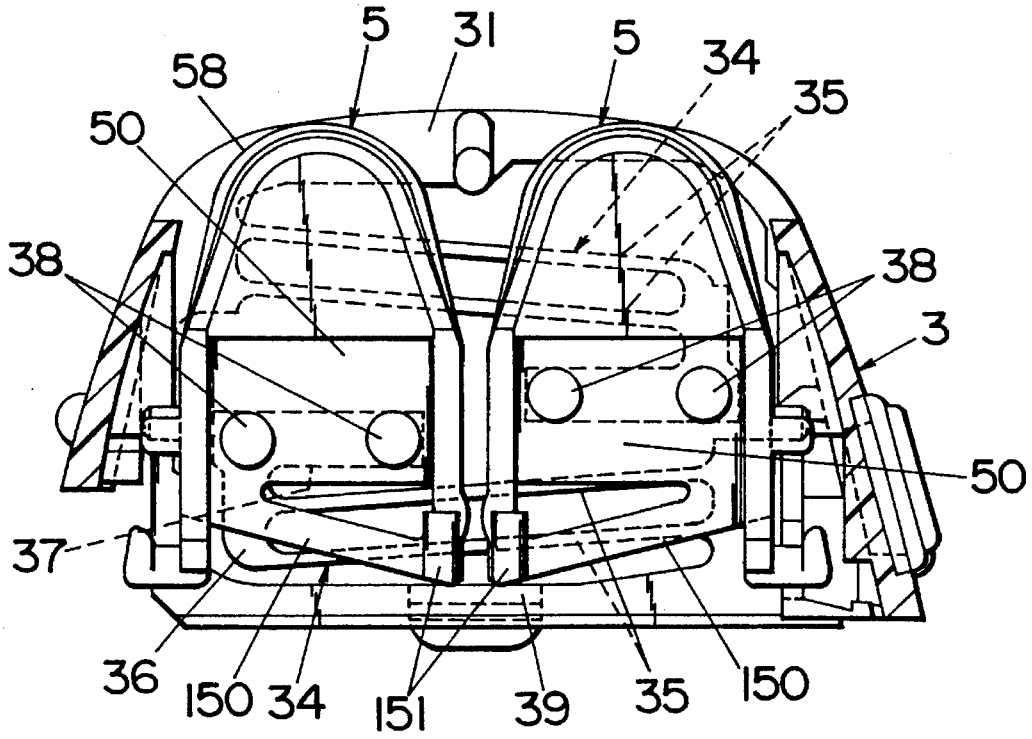

Formed within the thickness of each end wall 31 of the head frame 3 is a vertically spaced pair of cantilever 34 each extending integrally from the one lateral end toward the other lateral end of the end wall 31, as shown in FIGS. 3 and 6. In each pair, the cantilevers 34 comprises thin resilient parallel crossbars 35 extend from one lateral end of the end wall 31 and terminate into a coupler 36 at the respective free ends immediately adjacent the other lateral end of the end wall 31. Extending inwardly from the coupler 36 is a horizontal extension 37 provided with a pair of bosses 38 projecting inwardly for engagement into the corresponding holes 53 in the end plate 51 of the holder 50 of the cutter head 5. The crossbars 35 are made thin enough so as to be resiliently deformable within the thickness of the end wall 31, whereby the horizontal extension 37 is allowed to move vertically together with the coupler 36 by resiliently flexing the crossbars 35. Thus, the horizontal extension 37 is cooperative with the cantilevers 34 to define an elastic support member for supporting the corresponding longitudinal end of the cutter head 5 in a floating manner such that the one longitudinal end of the cutter head 5 is resiliently movable vertically substantially independently from the other longitudinal end. With this supporting structure, not only the two cutter heads 5 are allowed to move vertically independently from each other but also each cutter head 5 is allowed to move vertically in different vertical displacements at the two longitudinal ends so that each cutter head 5 can be inclined so as to best conform to the shape of the skin with a maximum skin engaging area. When the cutter head 5 is subjected to no external pressing force either from the skin or the inner cutter 70, each elastic support member, i.e., cantilever 34 including the resilient crossbars 35, the coupler 36 and the horizontal extension 37 assumes a neutral position, as shown in FIG. 6, where the crossbars 35 extends substantially horizontally. The cantilever 34 is permitted to be resiliently displaced upwardly, as shown in FIG. 7, and downwardly, as shown in FIG. 8. When the cutter heads 5 is mounted on the housing 1, the cutter heads 5 are displaced upwardly by the inner cutters 70 which are biased upwardly by the individual springs 82. Thus, during the shaving operation of pressing the cutter heads 5 against the skin of the user, the cutter heads 5 are permitted to be resiliently depressed downward by a large extent at either of the longitudinal ends. It should be particularly noted that, during an initial depression of the cutter head 5, i.e., until the elastic support member 34 is displaced to the neutral position of FIG. 6, the elastic support member 34 gives a downward elastic force which opposes the upward biasing force from the inner cutter 70 to thereby weaken a resulting floating force which is the combination of the spring biasing force from the spring 82 and the elastic force from the elastic support member 34. With this result, the cutter heads 70 can be easily depressed by a light load, i.e., can have increased compliance so as to follow the uneven skin surface of the user readily and smoothly for effective and comfortable shaving.

Figure 5:
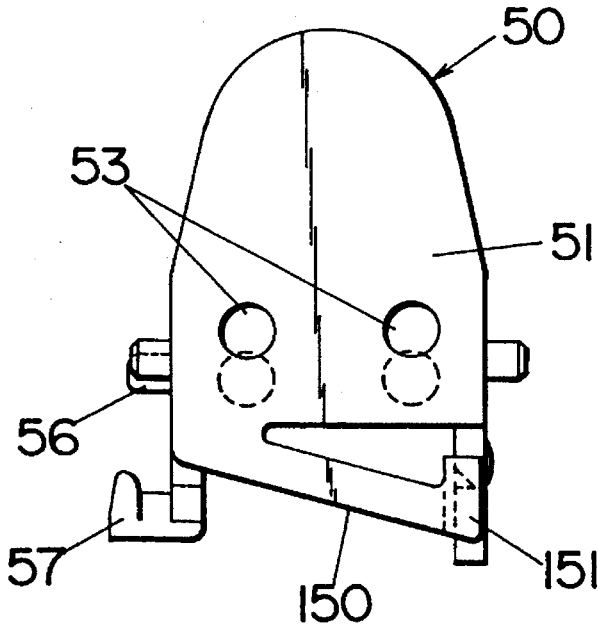
FIG. 5 is an end view of a holder of the cutting head.
Figure 9:
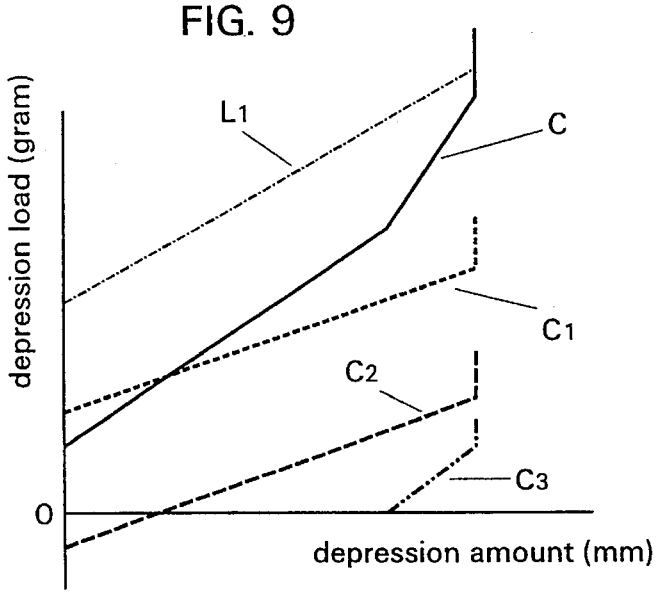
FIG. 9 is a graph illustrating elastic constant at which the cutter head is floatingly supported.
Figure 10:
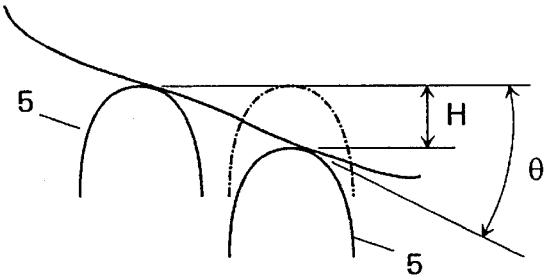
FIG. 10 is a schematic view illustrating the operation of the cutter heads.
Figure 11:
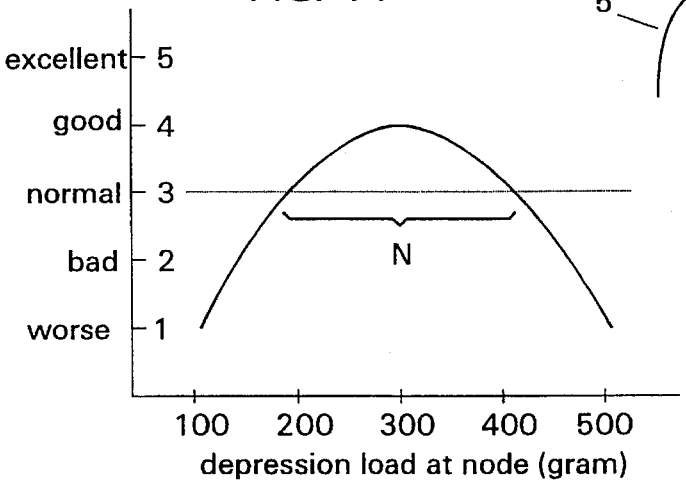
FIG. 11 is a graph illustrating a result of a five-graded sensory test with the cutter head depressed by varying depression load.

As best shown in FIG. 5, the holder 50 of each cutter head 5 is provided with a resilient leg 150 which extends in an inclined manner from one lateral end at the bottom of each end plate 51. The leg 150 is formed at its lower end with a foot 151 which is engageable with an inward patch 39 formed at the bottom center of the end wall 31 of the head frame 3. Normally, the foot 151 is spaced above the patch 39, as shown in FIG. 7. When the cutter head 5 is depressed to a certain depth associated with downward flexing of the cantilever 34, as shown in FIG. 8, the resilient leg 150 is made active to have the foot 151 abut against the patch 39 so that the resilient leg 150 will resiliently flex to exert an elastic force which is additive to the elastic force of the cantilever 34 to support the cutter head 5 with an increased floating force. Thus, the cutter head 5 will be depressed further with an increased load until the coupler 36 finally abuts against corresponding one of stops 130 formed in the end wall 31. In this manner, the cutter head 5 is floatingly supported from the head frame 3 so as to be initially depressed with a low elastic constant resulting from the combination of the two biases of the spring 82 and cantilever 34 and is further depressed with a high elastic constant resulting from the combination of the three biases of the spring 82, cantilever 34, and the resilient leg 150. This relation is indicated by an elasticity curve C in a graph of FIG. 9 in which the abscissa represents a depression amount (mm) of the cutter head 5 and the ordinate represents a depression load (gram) applied thereto. As seen in the figure, the elasticity curve C has a node which results from the combination of curve C2 for the cantilever 34 and elasticity curve C3 for the resilient leg 150, wherein C1 indicates elasticity curve for the spring 82 biasing the inner cutter 70. The node is selected to be within a depression load of 200 grams to 400 grams in view of a results of a 5-graded sensory test made for a number of subjects to obtain comfortable feeling which the subjects sense with varying depression loads. With the above-described floating support, the cutter head 5 can be depressed initially with a light load so that, as shown in FIG. 10, the two parallel cutter heads 5 can follow uneven skin surface smoothly with one cutter head depressed by a great extent H relative to the other cutter head 5, thus providing a large following angle θ within which the cutter heads can smoothly move across the skin for effective shaving without irritating the skin.

It is noted here that, as shown in FIG. 3, the lower cantilevers 34 in the opposite end walls 31 of the head frame 3 extends in opposing directions from the opposite lateral ends, as the upper cantilevers 34 do, and that the holder 50 of each cutter head 5 is connected at one longitudinal end to the lower cantilever 34 and at the other longitudinal end to the upper cantilever 34. In order to nevertheless support the cutter head 5 in a balanced manner, the head frame 3 is designed such that, as seen in FIG. 6, the horizontal extension 37 of the upper cantilever 34 extends from the lower end of the coupler 35, while the horizontal extension 37 of the lower cantilever 34 extends from the upper end of the coupler 35 so that the longitudinal ends of the holder 50 can be supported from the head frame 3 at around the same vertical level.

Further, since the two cutter head 5 are supported by individual support mechanism including the cantilevers 34 and the resilient legs 150, each cutter head 5 can be depressed without being interfered with the other cutter head 5 so as to be well pressed against the desired portion of the skin for effective shaving thereat.

One of the cutter heads 5 is coupled through the slider 60 to the slider handle 6 so that it can be held in a lower vertical position relative to the other cutter head 5 by manipulating the slider 60. Whereby only one of the cutter heads 5 is enabled while the other is disabled for successfully shaving the restricted area, for example, beneath the nose with one cutter head 5 without irritating the upper lip by the other cutter head 5.

Although the head frame 3 is shown to be detachably supported to the support frame 20 in the above embodiment, the present invention is not limited thereto and may be so constructed to eliminate the support frame and to mount the head frame 3 directly on the shaver housing instead.

Figure 12:
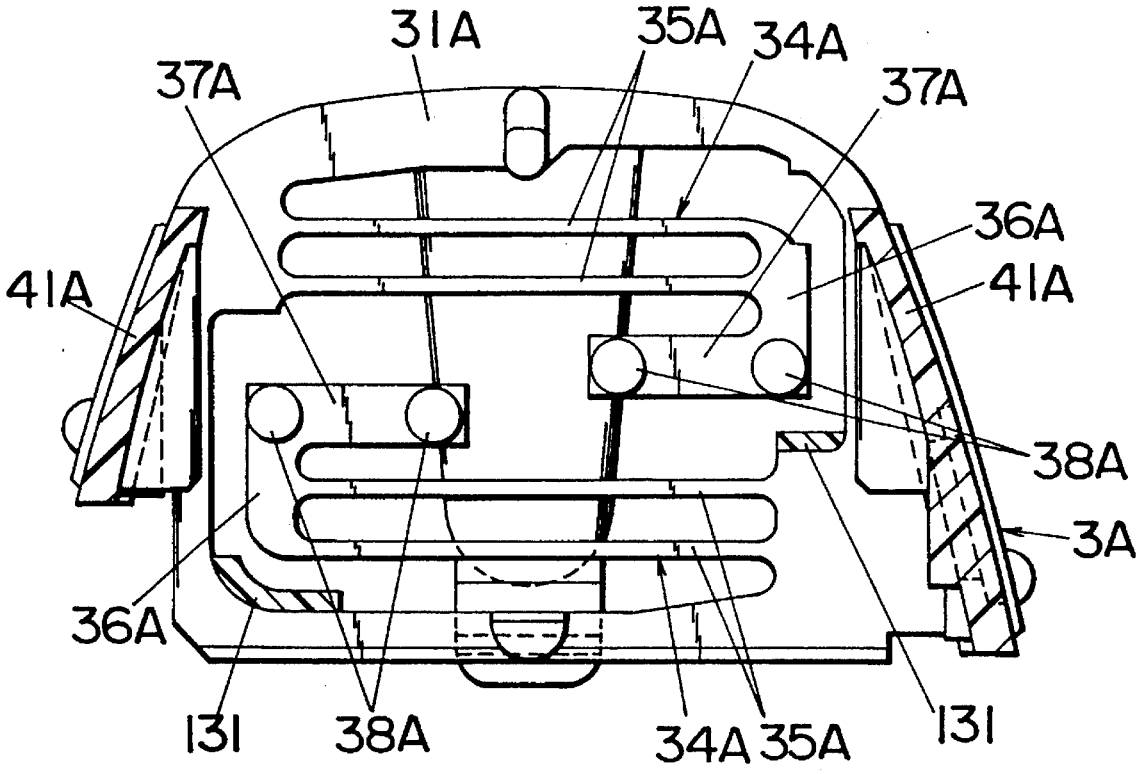
FIG. 12 is an end view, partly in section, of a head frame of a shaver in accordance with a second embodiment of the present invention.
Figure 13:
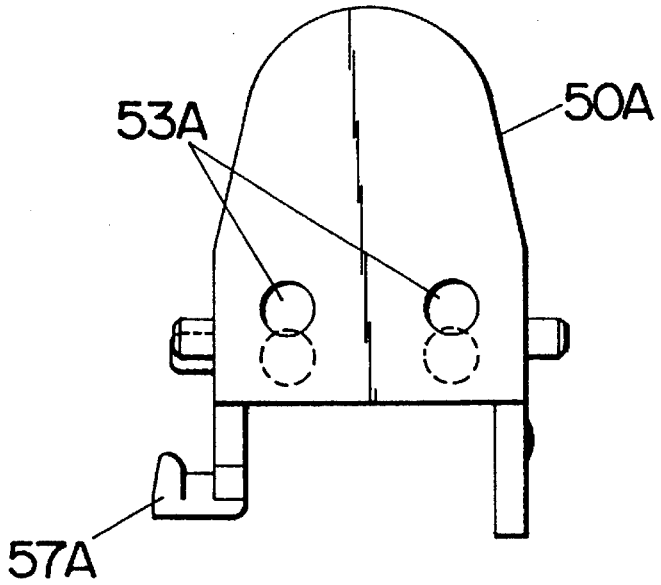
FIG. 13 is an end view of a holder of the cutting head utilized in the second embodiment.

FIGS. 12 and 13 illustrates a head frame 3A and a holder 50A of the cutter head of a dry shaver in accordance with a second embodiment of the present invention. The head frame 3A is identical in structure to that of the first embodiment except that rubbers 131 are added, while the holder 50A is identical in structure to that of the first embodiment except that the resilient leg is eliminated. For avoiding duplicate description and for easy reference purpose, like elements are designated by like numerals with a suffix letter of "A". The rubbers 131 are mounted on portions immediately adjacent the lower ends of the couplers 36A so that, after the cutter head is depressed to an extent that the coupler 36A abuts against the rubber 131 by downwardly flexing the cantilever 34A, the rubber 131 is made active to exert elastic force which is additive to the elastic force by the cantilever 34A, thereby floatingly supporting the cutter head with increased elastic constant.

Figure 14:
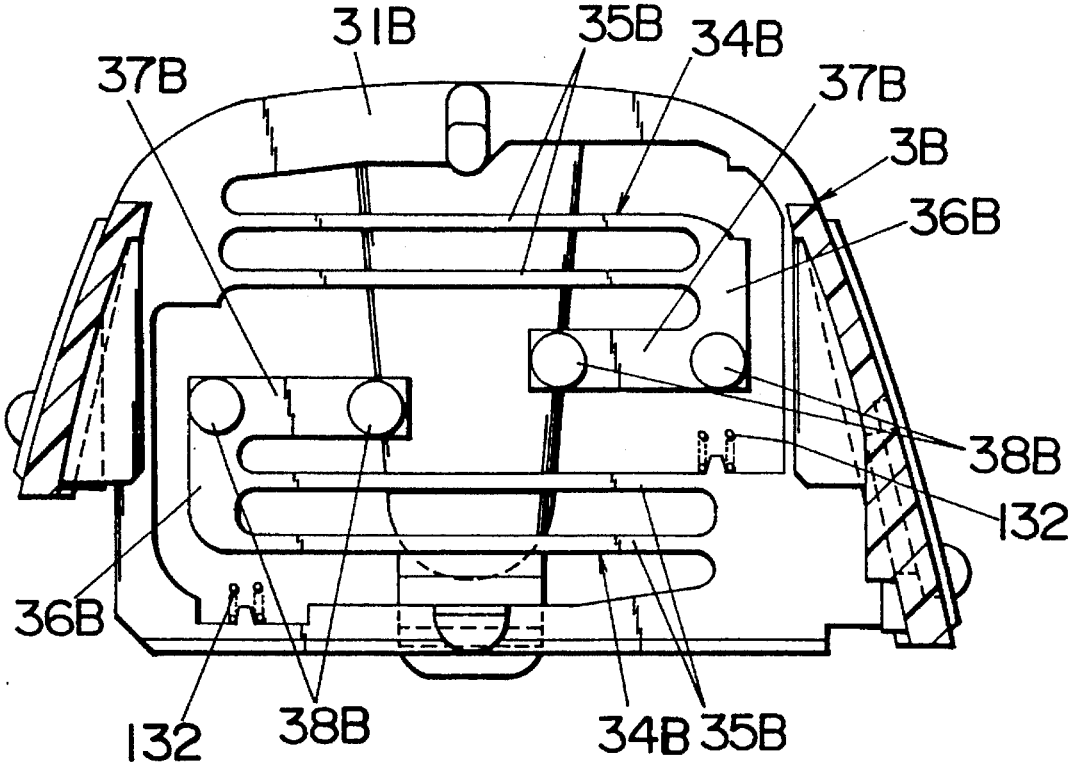
FIG. 14 is an end view, partly in section, of a head frame of a shaver in accordance with a third embodiment of the present invention.

FIG. 14 illustrates a head frame 3B of a dry shaver in accordance with a third embodiment which is identical in structure and operation to the second embodiment except that coil springs 132 are provided instead of the rubbers 131. Like elements are designated by like numerals with a suffix letter of "B".

Figure 15:
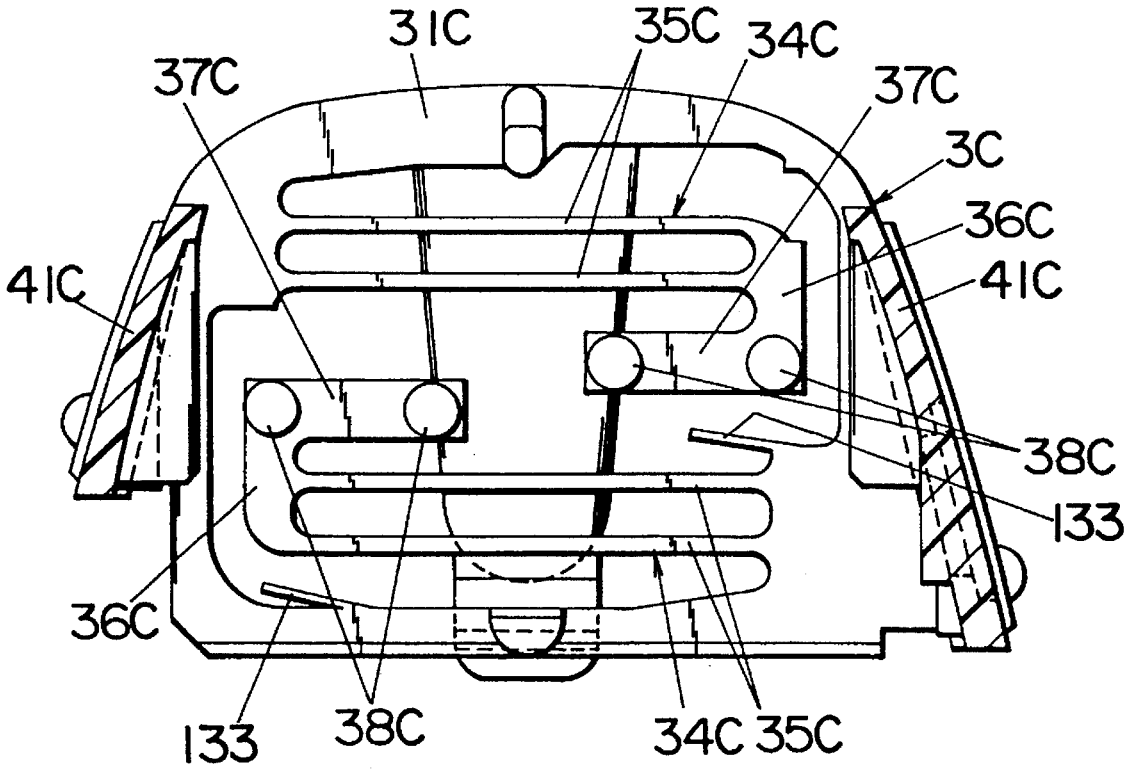
FIG. 15 is an end view, partly in section, of a head frame of a shaver in accordance with a fourth embodiment of the present invention.

FIG. 15 illustrates a head frame 3C of a dry shaver in accordance with a fourth embodiment which is identical in structure and operation to the second embodiment except that resilient beams 133 are provided instead of the rubbers 131. Like elements are designated by like numerals with a suffix letter of "C". The resilient beams 133 are molded integrally with the head frame 3C to extend in an inclined manner to resiliently support the horizontal extension 37C of the upper cantilever 34C and support the coupler 36C of the lower cantilever 34C, after the cutter heads are depressed by a limited extent.

Figure 17:
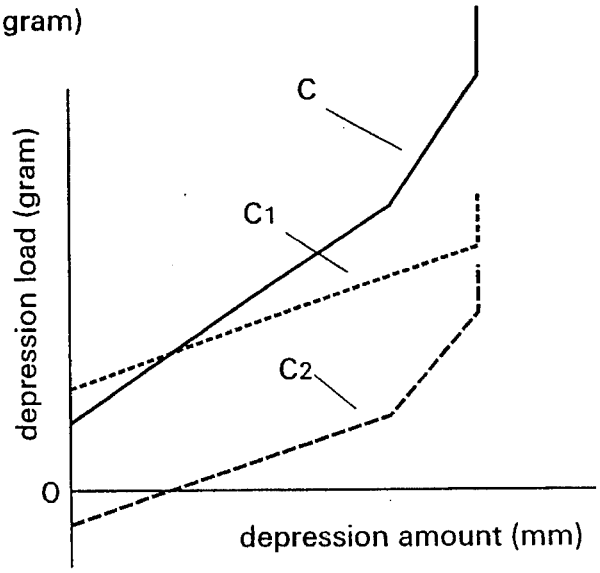
FIG. 17 is a graph illustrating elastic constant at which the cutter head is floatingly supported.
Figure 16:
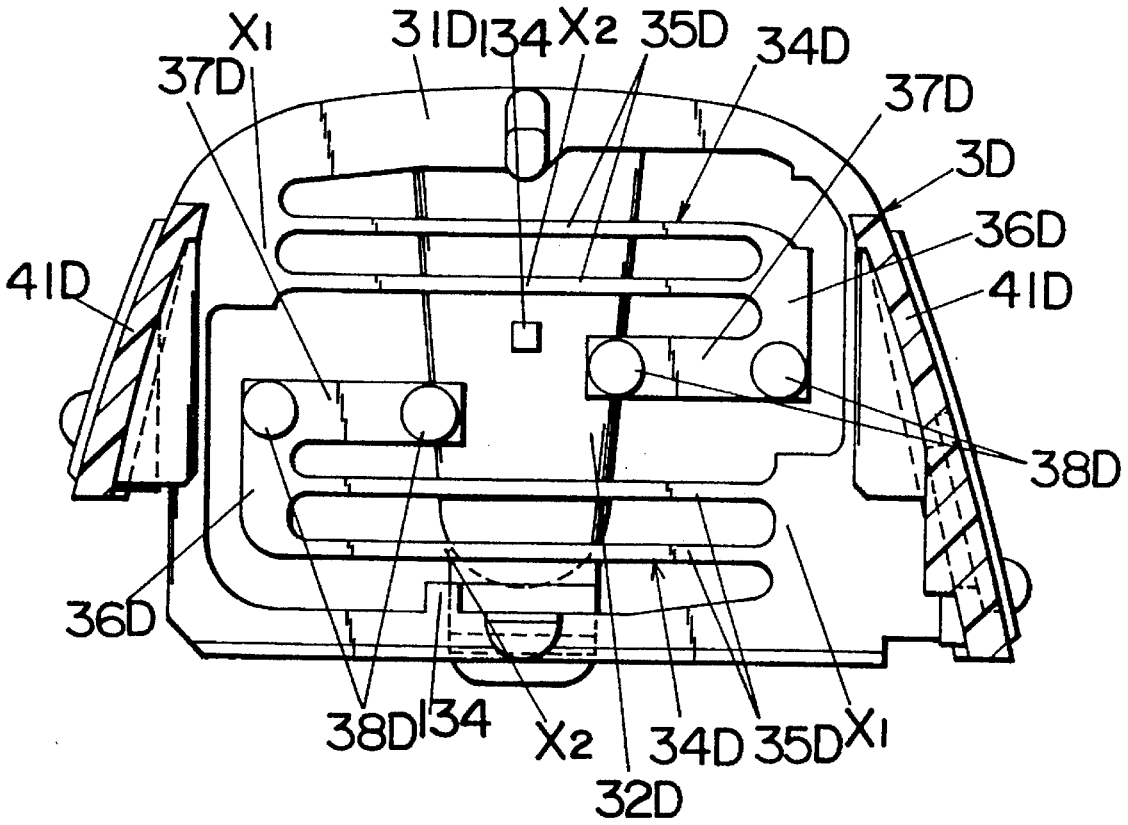
FIG. 16 is an end view, partly in section, of a head frame of the shaver in accordance with the above embodiment.

FIG. 16 illustrates a head frame 3D of a dry shaver in accordance with a fourth embodiment which is identical in structure and operation to the second embodiment except that props 134 are provided on the side of the head frame 3D at locations adjacent the middle portions of the individual cantilevers 34D. Until the cutter head is depressed to a point where the cantilever 34D has its resilient crossbar 35D abutting at the middle portion thereof against the corresponding prop 134, the cantilever 34D flexes about its anchored end, i.e., a first fulcrum X1 with a small elastic constant. After the cutter head is depressed beyond that point, the cantilever 34D will flex about a second fulcrum X2 defined at the abutment against the prop 134 with an increased elastic constant due to the shortened effective flexing length of the resilient crossbar 35D. Thus, the cutter head is floatingly supported with changing elastic constant in a manner similar to the above embodiments, as shown in FIG. 17 which illustrates an elasticity curve C for the relation between the depression displacement of the cutter and the depression load applied thereto. In the figure, the elasticity curve C is represented as a combination of elasticity curve C1 for the springs biasing the inner cutter and elasticity curve C2 for the cantilever 34D. With this arrangement, the cutter head can be floatingly supported with changing elastic constant simply by changing the effective length of the cantilever 34D, i.e., the resilient crossbar 35D and eliminating the necessity of adding another resilient member. Upper one of the props 134 is formed on the back of the knob 32D, while the lower prop 134 is formed on the bottom of the head frame 3D. Like elements are designated by like numerals with a suffix letter of "D".

What is claimed is:

1. A dry shaver comprising:

a head frame mounting at least one cutter head, said cutter head comprising a holder carrying an outer foil and an inner cutter which is driven to move in shearing contact with said outer foil;

spring means which gives a biasing force to bias said inner cutter against said outer foil so as to develop a contacting pressure therebetween; and floating support means for floatingly supporting said holder to said head frame so that said cutter head can be depressed relative to said head frame, said floating support means including elastic means for developing an elastic force when said cutter head is displaced relative to said head frame such that said cutter head receives a floating force which is a combination of said biasing force and said elastic force and which becomes greater as said cutter head is depressed further;

wherein said elastic means develops said elastic force which gives a non-linear relation between the displacement of said cutter head and a depression load applied thereto, said non-linear relation having a node of changing elastic constant for displacement of said holder such that the elastic constant is greater when said cutter head is depressed further beyond said node than otherwise;

said elastic means comprising a first elastic member and a second elastic member, said first elastic member being operative to give said elastic force until said cutter head is depressed to said node, and said second elastic member being cooperative with said first elastic member to give said elastic force only after said cutter head is depressed beyond said node.

2. A dry shaver as set forth in claim 1, wherein said first elastic member gives said elastic force which is opposed in direction to said biasing force from said spring means during an initial depression displacement of said cutter head so as to weaken the floating force during this displacement, after which said first elastic member gives the elastic force which acts in the same direction as said biasing force.

3. A dry shaver as set forth in claim 1, wherein said head frame has opposed end walls each having a width with two width ends, said first elastic member being formed in said end wall and in the form of a cantilever supported at its one end to one width end of said end wall and extending toward the other width end of said end wall to define a connection to said holder immediately adjacent to said other width end.

4. A dry shaver as set forth in claim 1, wherein said second elastic member is a resilient leg extends from said holder, said resilient leg coming into abutment at a free end thereof against a portion of said head frame after said cutter head is depressed by a limited extent such that said resilient leg is made active for floatingly supporting said holder with the greater elastic constant when said cutter head is depressed further beyond said limited extent than otherwise.

5. A dry shaver as set forth in claim 1, wherein said second elastic member is a rubber fixed on said head frame, said rubber coming into abutment with said first elastic member when said cutter head is depressed to a limited extent such that said rubber is responsible for floatingly supporting said holder with the greater elastic constant when said cutter head is depressed further beyond said limited extent than otherwise.

6. A dry shaver as set forth in claim 1, wherein said second elastic member is a spring fixed on said head frame, said spring coming into abutment with said first elastic member when said cutter head is depressed to a limited extent such that said spring is responsible for floatingly supporting said holder with the greater elastic constant when said cutter head is depressed further beyond said limited extent than otherwise.

7. A dry shaver as set forth in claim 1, wherein said second elastic member is a resilient beam extending from said head frame, said resilient beam coming into abutment at a free end thereof against said first elastic member after said cutter head is depressed by a limited extent such that said resilient beam is made active for floatingly supporting said holder with the greater elastic constant when said cutter head is depressed further beyond said limited extent than otherwise.

8. A dry shaver as set forth in claim 1, wherein said inner cutter is driven to reciprocate and wherein said first and second elastic members are both located at portions corresponding to opposite ends of said head frame with respect to the reciprocating direction of said inner cutter.

9. A dry shaver as set forth in claim 1, wherein a plurality of said cutter heads are disposed in parallel with each other and are provided individually with said second elastic members.

10. A dry shaver as set forth in claim 1, wherein said node is selected to arise in said depression load of 200 g to 400 g.

11. A dry shaver as set forth in claim 1, wherein said elastic means comprises an elastic crossbar which extends from said head frame with one end thereof anchored to said head frame and connected at the other end to said holder so that said elastic crossbar is allowed to flex about said one end defined as a first fulcrum for developing said elastic force as said cutter head is depressed, said elastic crossbar having a second fulcrum which is spaced away from said first fulcrum toward the connection to said holder, said elastic crossbar flexing about said first fulcrum to floatingly support said cutter head during an initial depression displacement of said cutter head and flexing about said second fulcrum to support the cutter head with said elastic constant greater when said cutter head is further depressed than during the initial depression displacement.

12. A dry shaver comprising:

a head frame mounting at least one cutter head, said cutter head comprising a holder carrying an outer foil and an inner cutter which is driven to move in shearing contact with said outer foil; and a pair of elastic members formed in said head frame for floatingly supporting said cutter head to said head frame so that said cutter head can be depressed relative to said head frame;

said head frame having opposed end walls spaced along the reciprocating direction of said inner cutter said end walls having width dimensions, said elastic members being formed in said opposed end walls, respectively;

at least one of said elastic members comprising a plurality of parallel crossbars supported at one end thereof to said end wall and connected at the other end to a coupler for connection with said holder, said crossbars extending from a width end of said end wall and terminating in said coupler which is located immediately adjacent to the other width end of said end wall;

wherein said head frame is formed in said end wall with a vertically spaced pair of said elastic members for supporting two said cutter heads disposed in parallel, the upper elastic member of said pair being connected to one of said cutter heads and the lower elastic member being connected to the other of said cutter heads for floatingly supporting said cutter heads individually.

* * * * *